US005452809A

United States Patent [19]

Capel

[11] Patent Number: 5,452,809

[45] Date of Patent: Sep. 26, 1995

[54] RUG RACK

[76] Inventor: Jesse S. Capel, 831 N. Main St., Troy, N.C. 27371

[21] Appl. No.: 144,192

[22] Filed: Oct. 27, 1993

[51] Int. Cl.[6] ..... A47F 7/00

[52] U.S. Cl. ..... 211/47; D6/410; 211/168; 211/169

[58] Field of Search ..... 211/47, 48, 46, 211/96, 168, 169, 189, 201, 195, 204; D6/409, 410, 429, 462

[56] References Cited

U.S. PATENT DOCUMENTS

| | | | |
|---|---|---|---|
| D. 134,111 | 10/1942 | Bersin et al. . | |
| D. 260,466 | 9/1981 | Butcher et al. | D6/410 |
| 791,851 | 6/1905 | Wood . | |
| 916,496 | 3/1909 | Shindlebower . | |
| 920,962 | 5/1909 | Kepke . | |
| 1,061,001 | 5/1913 | Nelson . | |
| 1,088,128 | 2/1914 | Cleary et al. . | |
| 1,378,692 | 5/1921 | Leffel | 211/47 |
| 2,000,336 | 5/1935 | Kerr . | |
| 3,187,900 | 6/1965 | Schneider . | |
| 3,315,813 | 4/1967 | Schneider . | |
| 3,330,418 | 7/1967 | Schneider . | |
| 3,351,211 | 11/1967 | Best | D6/410 X |
| 3,603,461 | 9/1971 | Best . | |
| 3,722,702 | 3/1973 | Marker et al. | 211/204 |
| 4,146,141 | 3/1979 | Winter et al. | 211/123 X |

OTHER PUBLICATIONS

Self Service Volume Rug Sales, Sel-o-Vak, "Rug Center", Cat. No. G10, Apr. 2, 1965.

*Primary Examiner*—Robert W. Gibson, Jr.
*Attorney, Agent, or Firm*—Shefte, Pinckney & Sawyer

[57] ABSTRACT

A rug rack includes a pair of similar frame structures supported in substantially parallel, spaced relation by an intermediate frame structure extending diagonally between and secured to both of said frame structures. The rug rack is free-standing, and does not need to be secured to any other supporting structure. A plurality of rug supporting members are pivotally secured to said intermediate frame structure for holding respective rugs in depending position, each being freely pivotable into a viewing position. The pair of frame structures further includes outboard supports for holding a plurality of rolled rugs in axially upright position. A canopy surrounds the upper portion of the rug rack, and has lights mounted interiorly thereof to illuminate rugs supported by said rug rack.

9 Claims, 5 Drawing Sheets

RUG RACK

BACKGROUND OF THE INVENTION

Small rugs of the type often known as "throw rugs" are of rectangular or oval shape and may be a few feet in each dimension. They commonly are ornamental, and are picked for purchase in accordance with the colors thereof for harmonization with the intended location in a dwelling or the like, and also for the design. Thus, it is necessary for a shopper to be able to see the entire surface of a rug, or of several rugs, before making a purchase. Sometimes a plurality of such rugs is simply stacked on top of one another, leaving only the top one fully visible. The stack must be manipulated in order for a shopper to see even a portion of a rug except for the top rug.

Racks have been provided for supporting such rugs for display purposes. However, such racks have been inefficient in the use of floor space, and generally have been quite limited in the number of rugs that can be readily displayed.

OBJECTS AND SUMMARY OF THE PRESENT INVENTION

It is an object of the present invention to provide a rug rack which is highly efficient in the use of floor space, and which is rugged and stable.

It is further an object of the present invention to provide such a rug rack in which rugs are individually supported and displayed for ready visibility thereof.

In carrying out the principles of the present invention there is provided a pair of parallel end frame members, interconnected by a diagonally disposed central frame. This provides the rug rack with substantially a Z-shape from when viewed from above. The diagonal intermediate frame is provided with a plurality of pivotally mounted rug support members, which when pivoted provide ready visibility of rugs on the rack on a one-by-one basis. The diagonal nature of the intermediate frame provides for a maximum length of frame for a minimum size floor space, i.e. from one end frame to the other. In addition, each of the end frames is provided with a floor for supporting a plurality of rolled rugs, and with restraining or positioning means for holding said rolled rugs in upright position for ready visibility thereof.

THE DRAWINGS

The present invention will best be understood from reading the following specification, taken in conjunction with the accompanying drawings wherein:

FIG. 1 a perspective view of a rug rack constructed in accordance with the present invention, and having a portion broken away for improved visibility;

DETAILED DISCLOSURE OF THE ILLUSTRATED EMBODIMENT

Figure 1:
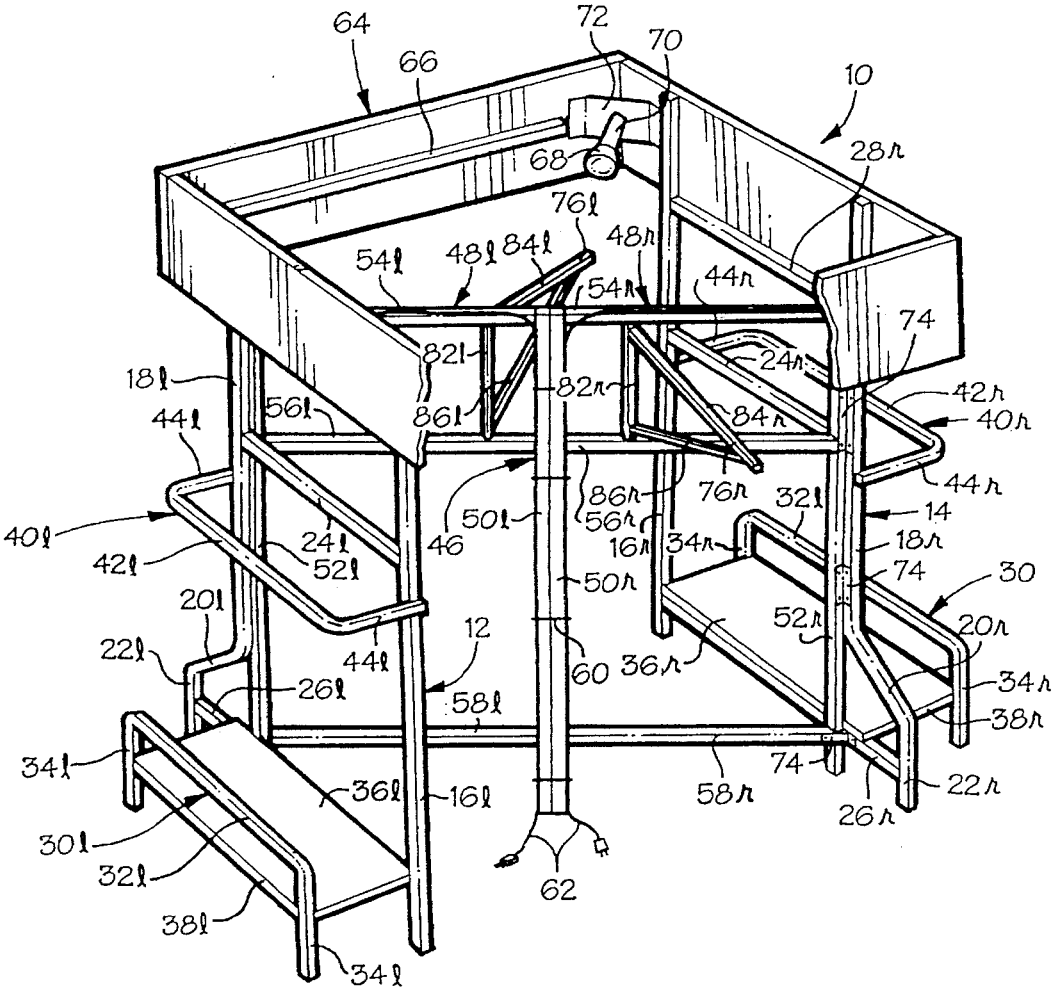
FIG. 1A is a perspective view illustrated the manner in which the individual rug supports are pivotally mounted to the diagonal frame.
Figure 2:
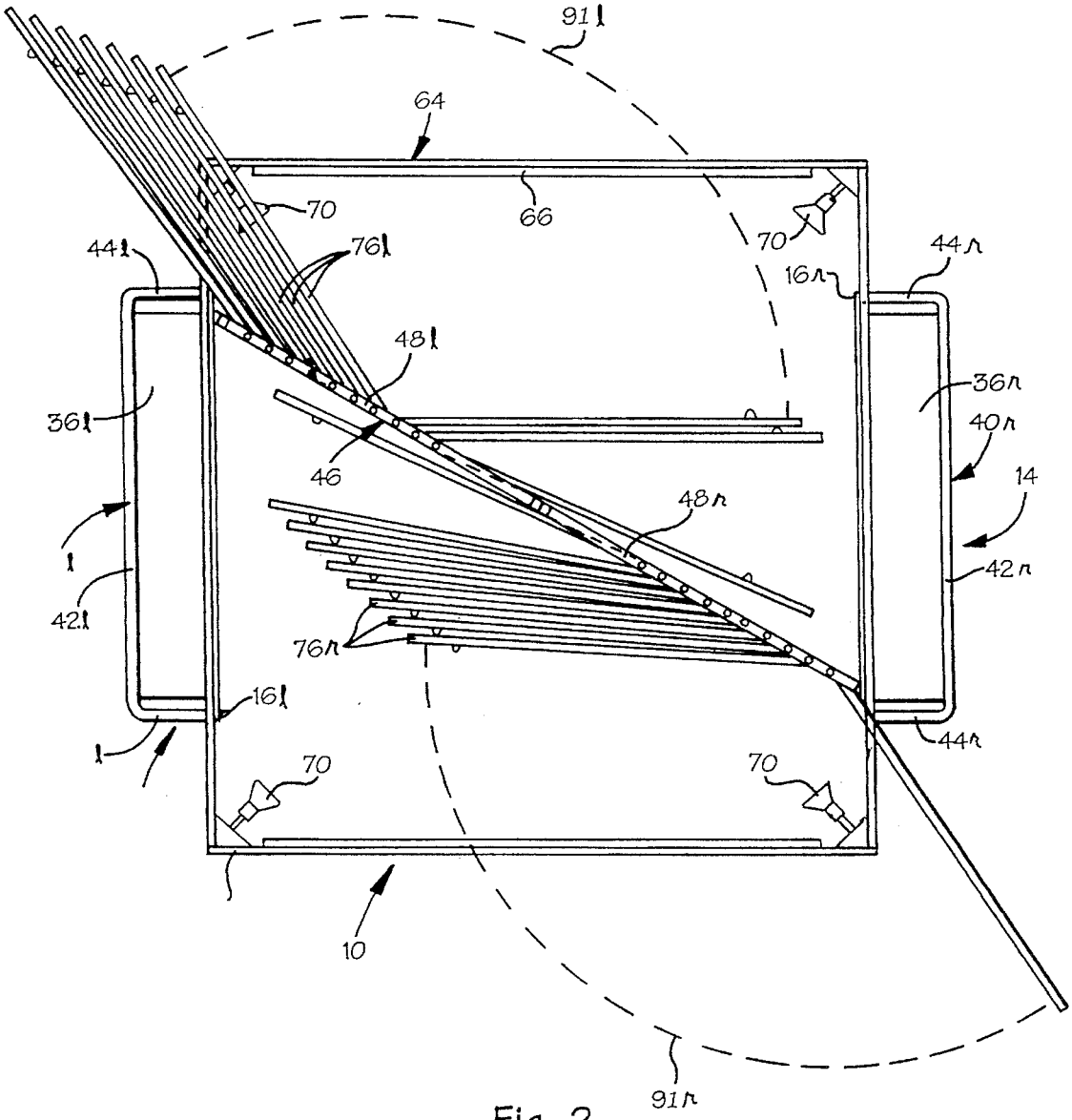
FIG. 2 is a top view of the rug rack shown in FIG. 1.

Turning now in greater particularity to the drawings, a rug rack 10 constructed in accordance with the principles of the present invention will be seen particularly in FIGS. 1 and 2. Portions of the rug rack will be referred to as left and right in accordance with the position of the rack in the drawings, particularly FIGS. 1 and 2. The rug rack includes a pair of end frames, specifically a first or left end frame 12, and a second or right end frame 14. The end frames 12 and 14 are essentially the same as one another, and to avoid duplication of description, similar numerals will be used to identify similar parts, with the addition of the letter l for the left end frame parts, and the addition of the letter r with reference to the right end frame parts. At the forward portion of the left end frame 12 there is a vertical upright member 16-*l* of square cross-section, and constructed of a suitable metal, aluminum being one example. There is a similar upright member 16-*r* at the back portion of the right end frame. At the left end, there is also a mostly upright member 18-*l* with a diagonal offset 20-*l* leading to a lower vertical portion 22-*l*. A horizontal member 24-*l* of similar nature interconnects the upright members 16-*l* and 18-*l* somewhat above the mid-portion thereof, and there is also a lower interconnecting portion 26-*l*, both being horizontal. There is a similar part that is not shown in FIG. 1, so reference is made specifically to the third cross member 28-*r* adjacent to, but spaced down from the upper ends of the uprights 16-*r* and 16-*l*. A vertically disposed, downwardly opening shallow U-shaped support 30-*l* comprises an elongated horizontal member 32-*l* and a pair of spaced vertical or upright members 34-*l* depending therefrom spaced from the uprights 16-*l* and 18-*l*. A metal shelf 36-*l* is secured to the horizontal cross member 26-*l*, and to the vertical members 34-*l*, the shelf being provided with a peripheral depending flange 38-*l* to provide strength and rigidity. These parts are preferably welded together.

The left end frame 12 is completed by a positioning member 40-*l* secured such as by welding to the upright members 16-*l* and 18-*l* shortly below the cross member 24-*l*. The restraining member 40-*l* is of horizontal, shallow U-shape, including an elongated bight 42-*l* and a pair of legs 44-*l*. Similar structure at 40-*r* is secured to the right end frame member.

The rug rack further includes an intermediate frame 46 interconnecting the left and right frames 12 and 14. The intermediate frame 46 is oblique or diagonal relative to the end frame members 12 and 14, and for economy of space in shipping is made as two subsections 48-*l* and 48-*r*. Each subsection is substantially rectangular, and with reference to the left section, there is a square upright member 50-*l* at the center of the frame 6, and an outside upright member 52-*l*. An upper horizontal cross member 54-*l*, an intermediate horizontal cross member 56-*l* at about the same height as the cross member 24-*l* of the left end frame 12, and a lower cross member 58-*l* spaced upwardly from the floor or other supporting surface are welded or otherwise suitably secured at their ends to the upright members 50-*l* and 52-*l*. The right central frame section 48-*r* is a mirror image of the left central frame section, and the two upright members 50-*l* and 50-*r* are secured together by elements such as screw fasteners or encircling clamp members such that the two frame sections 58-*l* and 58-*r* lie in a common plane, as readily can be seen in FIG. 2. At this point it will be observed that the lower ends of all of the upright members are coplanar so that all may rest on a floor or other supporting surface. It will be understood that conventional rubber or plastic fittings may be applied to the lower ends to avoid damage to a supporting surface. It further will be observed that flexible electric wires 62 with plugs thereon extend from the bottom of the upright members 50-*l* and 50-*r*, exiting therefrom through a suitable notches or recesses. The wires could extend upwardly without passing through the uprights 50-*l* and 50-*r* when an overhead electric outlet is available.

At the upper portion of the rug rack there is a square canopy 64, preferably made in four pieces for economy of space in shipping, and suitably secured together as by screw elements. The canopy 64 is secured as by screw elements outwardly of the upper ends of the upright members 16-*l*, 16-*r*, 18-*l* and 18-*r*. Protective channels 66 lie on the inner faces of the canopy members to protect the end portions of the wires 62, which wires lead through the horizontal channels 54-*l* and 54-*r* and into the uprights 60-*l* and 60-*r*. Four flood lights 68 are mounted in suitable fixtures 70 which are fixed on gusset plates 72 and mounted in the four corners of the canopy. Thus, the plugs at the lower ends of the wires 62 may be connected by way of an extension cord to conventional power outlets. Thus, rugs supported by the rack are brightly illuminated without spreading light outwardly of the rug rack to areas which need not be brightly lighted. The flat panels comprising the canopy 64 preferably are provided with horizontal edge flanges for strength and rigidity.

The intermediate frame 46 is secured to the end frames by means of suitable angle irons 74 secured to the upright members 52 and 18 at either end by means of suitable screw fasteners.

Figure 1A:
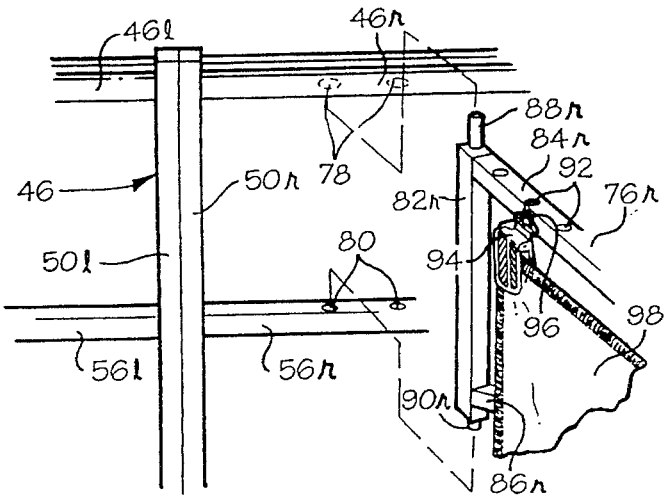

A plurality of rug supporting members 76-*l* is pivotally supported by the horizontal members 46-*l* and 56-*l* and projecting generally rearwardly, while a similar plurality of rug supporting members 76-*r* project forwardly, being pivotally mounted by the horizontal members 46-*r* and 56-*r*. Many such supporting members are shown in FIG. 2, but only one of each is shown in FIG. 1, and a single supporting member 76-*r* in FIG. 1A for clarity of illustration. As may be seen in the three figures, the upper horizontal channels 46-*r* are provided with a series of holes 78 spaced therealong. Similarly, the horizontal members such as 56-*r* are provided with holes 80 respectively aligned with the holes 78. Each supporting member 76-*l* and 76-*r* is of substantially triangular construction, including a vertical member 82-*l*, 82-*r*, a horizontal member 84-*l*, 84-*r* at the upper end of the respective upright member, and a diagonal bracing member 86-*l*, 86-*r*, spaced upwardly on the vertical member as 82-*r*, and inwardly on a horizontal member, as 76-*r*, thus departing slightly from a true triangular shape. The supporting member is completed by a diagonal brace 86-*r* which is secured to the vertical member 82-*r* slightly above the bottom, and to the horizontal member 84-*r* slightly in from the outer end, thereby departing from a true triangle. An upwardly extending relatively long pivot pin 88-*r* extends from the vertical member 82-*r*, while a shorter pin 90-*r* depends from the lower end of the vertical member 82-*r*, the two pins being aligned with one another. The upper pin 88-*r* is longer, and can be moved up into one of the holes 78. With the supporting member held in elevated position the depending pin 90-*r* can be aligned with one of the lower holes 80, and lowered thereinto upon lowering of the supporting member. The substantially triangular supporting members, including all such members, thus are pivotal as indicated by the arcuate lines 91-*l* and 91-*r* in FIG. 2, thus selectively to make each rug supported by one of the members individually viewable.

Figure 3:
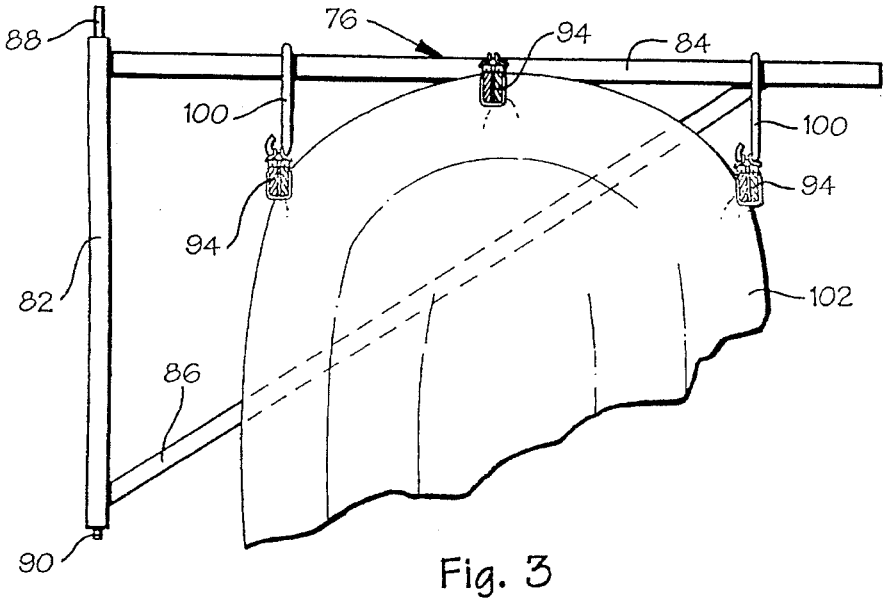
FIG. 3 is an enlarged front view showing the suspension of an individual rug from one of the pivoted supports.
Figure 3A:
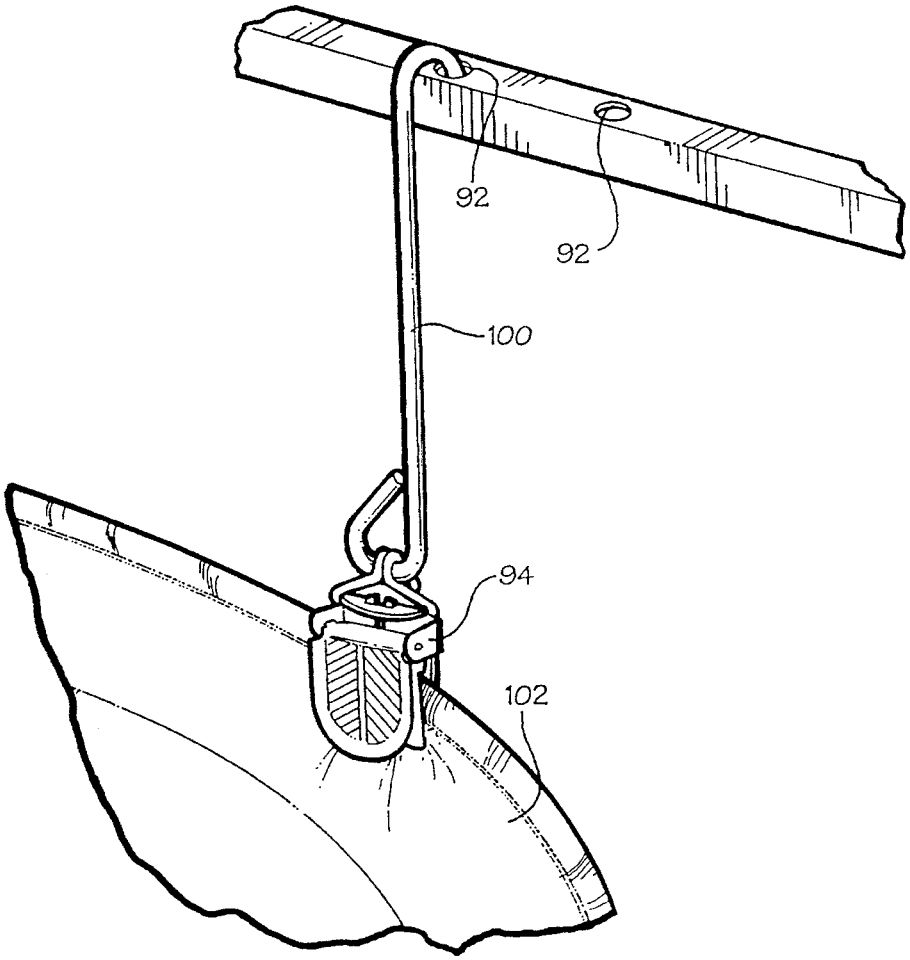
FIG. 3A is a perspective view similar to a portion of FIG. 3 showing the suspension of a rug.

The horizontal frame member, as 84-*r*, of each triangular rug supporting member is provided with a plurality of holes 92 spaced therealong. Spring clips 94 having short hoop-like members 96 at the top inserted in appropriate ones of the holes 92 are used to support square or rectangular rugs as indicated at 98 in FIG. 1A. In the case of oval or otherwise non-rectangular rugs, elongated hangers 100 (FIGS. 3 and 3A) are used to support the spring clips 94 at lower elevations, while one or more spring clips 94 may be secured directly to the horizontal member 84 as previously indicated for supporting, for example, an oval rug 102.

Figure 4:
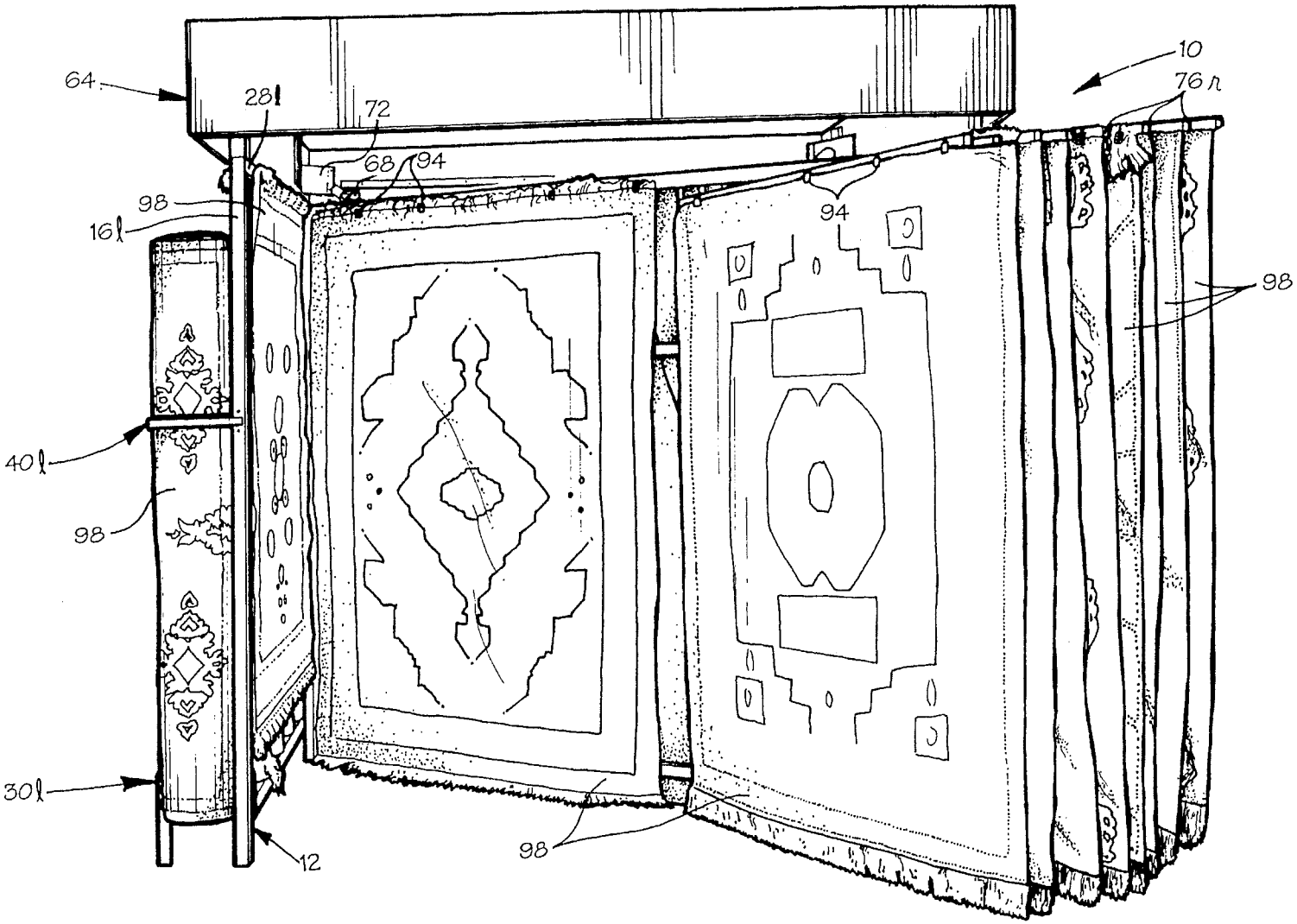
FIG. 4 is a front perspective view of the rug rack constructed in accordance with the principles of the present invention, and showing the support of a plurality of rugs thereon.
Figure 5:
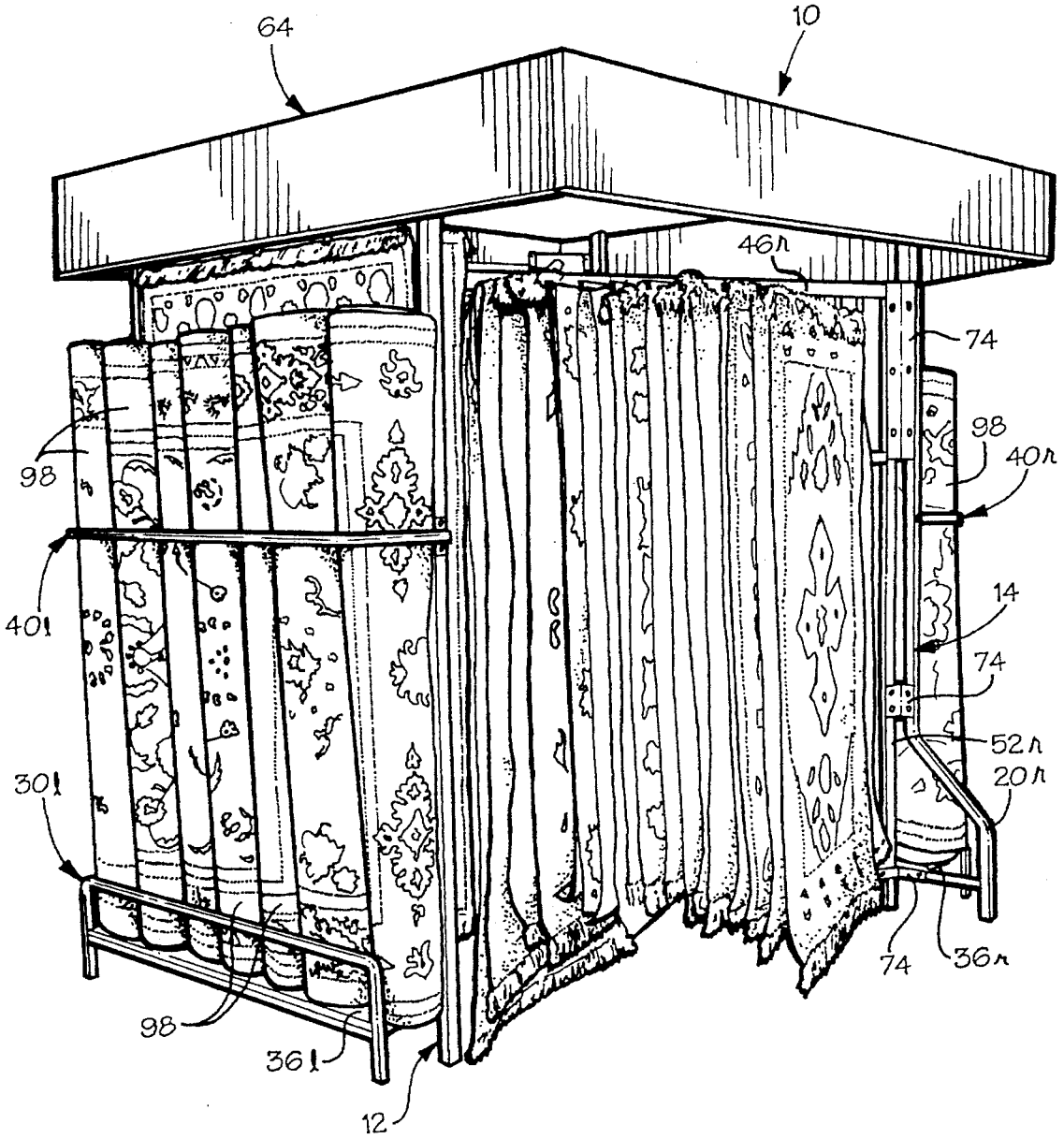
FIG. 5 is a corner perspective view of the rug rack of FIG. 4.

Reference to FIGS. 4 and 5, taken in connection also with FIG. 2, gives a good idea of how many rugs can be suspended from the supporting members or hangers 76 with selected rugs fully shown. Additional rugs 98 can be secured by clips to the upper cross members 28-*r* and 28-*l*, while a further plurality of rugs are rolled into cylinders, and supported on the floor or plates 36-*l* and 36-*r*, being held in position by the restraint or U-shaped structures 48-*l* and 48-*r*, with the lower portions of such rolled rugs being restrained by the inverted U-shaped members 30-*l*.

It will be apparent that a very large number of rugs can be displayed in a minimum of space with all or significant portions of the rugs individually displayed for viewing and choice by customers. The rug rack does not have to be displayed in a brightly lighted position, for the four lamps 68 carried by the canopy supply a large amount of light for display of the rugs, particularly those carried by the supporting members 76. Despite the rather small size of the rug rack the rack is quite stable, due to carrying of large portions of the rugs within the outline of the rug rack, or immediately outside thereof adjacent the end frames 12 and 14. Furthermore, it has been noted that the parts of the rug rack are carried as relatively small pieces for shipment, being spot assembled for use. The metal parts are readily fabricated in a small shop, and consequently are quite inexpensive, whereby the entire rug rack is of much more economical construction than might be suspected from the fine display of rugs that it provides.

The specific example of the invention as herein shown and described will be understood as being for illustrative purposes. Various changes will possibly occur to those skilled in the art, and will be understood as forming a part of the present invention insofar as they fall within the scope of the appended claims.

The invention is claimed as follows:

1. A rug rack comprising a first upstanding frame structure, a second upstanding frame structure substantially similar to said first frame structure disposed in spaced relation to said first upstanding frame structure and substantially parallel thereto, an intermediate upstanding frame structure extending between said first frame structure and said second frame structure and forming acute angles with and secured to both of said first frame structure and said second frame structure, and a plurality of rug supporting members secured to and extending from said intermediate frame structure, said plurality of said rug supporting members extending laterally from said intermediate frame structure, some of said supporting members extending substantially in a first direction from said intermediate frame structure, and some of said supporting members extending substantially in a second direction substantially opposite to said first direction, thereby substantially effecting balance of said rug rack.

2. A rug rack comprising:

a first upstanding frame structure, a second upstanding frame structure substantially similar to said first frame structure and substantially parallel thereto, an intermediate upstanding frame structure having two ends and opposed sides, said intermediate frame structure secured at one end to said first frame structure and secured at the other end to said second frame structure, said intermediate frame structure extending diagonally and forming an acute angle between one of said sides and said first frame structure and an acute angle between the other of said sides and said second frame structure, a first plurality of adjacent rug supporting members secured to and extending laterally from said one side of said intermediate frame structure adjacent the acute angle formed by said other side and said second frame structure, and a second plurality of adjacent rug supporting members secured to and extending laterally from said other side of said intermediate frame structure adjacent the acute angle formed by said one side and said first frame structure.

3. A rug rack as set forth in claim 1 and further including a plurality of pivot means supporting said rug supporting members from said intermediate frame structure.

4. A rug rack as set forth in claim 1 and further including means on at least some of said rug supporting members including spring clips for holding rugs in an upright, depending position.

5. A rug rack as set forth in claim 4 and further including extended suspension members securing at least some of said spring clips from said rug supporting members at a vertical distance therefrom for supporting a non-rectangular rug.

6. A rug rack as set forth in claim 2 wherein at least one of said first and second frame structures has means for supporting a plurality of rolled rugs in axially upright position.

7. A rug rack as set forth in claim 6 wherein both of said first and second frame structures have means for supporting a plurality of rolled rugs in axially upright position.

8. A rug rack as set forth in claim 1 and further including a canopy, and means supporting said canopy secured to upper portions of at least some of said upstanding frame structures for bracing said rug rack.

9. A rug rack as set forth in claim 8 and further including a plurality of lights, and means mounting said lights from said canopy for illuminating rugs supported by said rug rack.

* * * * *